United States Patent [19]

Klancnik

[11] 4,092,749

[45] June 6, 1978

[54] MATTRESS SPRING UNIT CONSTRUCTION

[75] Inventor: Alvin R. Klancnik, Park Ridge, Ill.

[73] Assignee: Sealy, Incorporated, Chicago, Ill.

[21] Appl. No.: 757,237

[22] Filed: Jan. 6, 1977

[51] Int. Cl.[2] ..... A47C 23/04

[52] U.S. Cl. ..... 5/267; 5/247; 5/274

[58] Field of Search ..... 5/247, 264, 267, 269, 5/274, 354

[56] References Cited

U.S. PATENT DOCUMENTS

| | | | |
|---|---|---|---|
| 2,195,759 | 4/1940 | Schield | 5/263 |
| 2,473,706 | 6/1949 | Gleason | 5/269 |
| 3,052,460 | 9/1962 | Mechman, Jr. | 5/267 |
| 3,242,505 | 3/1966 | Tyhanic | 5/267 |
| 3,576,040 | 4/1971 | Larsen | 5/354 |

*Primary Examiner*—Casmir A. Nunberg

*Attorney, Agent, or Firm*—Hume, Clement, Brinks, Willian & Olds, Ltd.

[57] ABSTRACT

An improved mattress innerspring unit is provided including cross helicals which extend transversely of the rows of coil springs and lace together adjacent terminal convolutions of the springs in a row and a retention and support strip which overlies the terminal convolutions of the springs in a row of the unit, the retention and support strip and the helicals being crimped together and otherwise secured about the interlaced portions of the coil springs. The cross helicals are prevented from spinning out of the unit and the unit is firmed, particularly in the area close to the retention and support strip. Preferably, retention and support strips are provided along both the top and bottom terminal convolutions of the coil springs of at least one row near each of the two longitudinal edges of the innerspring unit.

37 Claims, 6 Drawing Figures

MATTRESS SPRING UNIT CONSTRUCTION

BACKGROUND OF THE INVENTION

This invention relates to improvement in mattress innerspring units and, more particularly, to a means for preventing spin-out of cross helicals therein and for stiffening or firming an innerspring unit or a portion of the unit, such as the longitudinal side border regions.

Mattress innerspring units are generally formed of a plurality of coil springs arranged in side-by-side relation in a plurality of parallel rows between upper and lower border wires. The border wires are generally connected to the coil springs at the perimeter of the unit. It has been the practice to interconnect the coil springs of a row at their upper and lower terminal convolutions, respectively, with a plurality of helical coils (cross helicals) extending transversely across each of the rows of the unit. The coil springs are interconnected by rotating or threading each cross helical spirally about its major axis until it is extended transversely of each of the rows lacing together the terminal convolutions of the coil springs along the adjacent edges of such convolutions. The terminal convolutions of coil springs are generally closed circular loops which may have offset portions on opposite sides which offsets provide a straight portion about which the cross helical laces.

Once the cross helicals are in position they have a tendency to "spin-out", that is, unwind from the innerspring unit. To eliminate this action, it has been the practice to deform the cross helicals in various manners. For example, each end of a cross helical can be given a reverse twist, which is the doubling back of the end portion of the helical on itself. Alternatively, a cross helical, at portions of its length between interlaced convolutions of coil springs, can have several of its convolutions rotated about an axis transverse to the axis of the cross helical, as shown for example in U.S. Pat. No. 3,685,062. A further method of eliminating cross helical spin-out is to crimp or compress portions of each cross helical near its opposite ends to frictionally engage the helical with the laced adjacent terminal convolutions of the coil springs of the first or second outermost row of the innerspring unit, as described in U.S. Pat. No. 3,653,082. This latter method has the further advantage of stiffening the mattress innerspring unit in the area in which the cross helicals have been crimped. Although these methods have reduced spin-out, none have completely eliminated cross helical spin-out.

It is desirable that mattress innerspring units be firm which firmness is related in part to the number of coil springs in the innerspring unit, i.e. the coil count. It is also desirable that the longitudinal side borders of mattress innerspring units be firmer than the center or end portions. The crimping of helicals about the end convolution offsets of coil springs at the sides of a unit, as described also in U.S. Pat. No. 3,653,082, does increase firmness at the sides of the innerspring unit. An even greater degree of firmness, however, would be advantageous. It may also be desired to provide additional firmness at the other regions of the innerspring unit, such as the longitudinal mid-region of a wide mattress.

It is therefore an object of the present invention to provide a means for a mattress innerspring unit which will reduce cross helical spin-out and increase the firmness of the unit.

It is another object to provide a retention and support strip which may be secured in such a manner to an innerspring unit at the point where the cross helicals interlace adjacent coil springs to reduce cross helical spin-out and increase the firmness of the unit.

It is a further object to provide a mattress innerspring unit containing cross helicals interlacing adjacent coil springs where a retention and support strip is positioned along the upper and lower terminal convolutions of coil springs in at least one row (such as the first, second, and/or third rows of springs adjacent to the side border wires of the unit) which strip grips the adjacent portions of the cross helicals and which helicals frictionally engage the terminal convolutions of the springs in such rows so as to reduce helical spin-out, provide additional firmness to the unit and bridge the springs in these rows.

SUMMARY OF THE INVENTION

The foregoing and other objects are realized in accord with the invention by a retention and support strip for attachment to a generally rectangular mattress innerspring unit comprising a plurality of coil springs arranged in rows such that the portions of the terminal convolutions of each coil spring in a row are in close proximity. The coil springs of each row are interconnected by spirally rotating cross helicals across the rows to interlace the adjacent portions of the terminal convolutions of the coil springs. These adjacent portions of terminal convolutions which are laced may be formed as U-shaped offsets.

The retention and support strip can be positioned along any row of coil springs, laying on the uppermost or lowermost convolutions of the springs. The strip includes leg members along its length which leg members are disposed inwardly from the strip into the unit at positions where the strip overlies the cross helicals. The leg members extend about the cross helicals. The cross helicals together with the leg members are crimped around the laced portions of coil springs. The crimping reduces the diameter of each cross helical to approximately the same cross-sectional area as the laced portions of the spring and wraps the adjacent leg about the helical. The cross helical coil is thereby frictionally engaged not only with the laced portions of the springs but also with the adjacent leg providing a stronger frictional engagement and reducing the tendency of the cross helical to spin-out as compared to crimping the helical without a leg of the retention and support strip.

Further, the leg cooperates with the length of the strip from which it extends and with the other crimped legs along the length to provide a bridge between the springs in the rows. When pressure is applied to one or several springs in the row, the cooperation of the elements of the strip transfers a part of the pressure to the other springs in the row, i.e. the strip causes other springs in the row to resist that pressure. When the laced portions of the terminal convolutions of the springs are formed as offsets, which preferably are positioned in overlapping relationship with adjacent offsets, the crimped cross helicals and leg members of the strip reduce the tendency of the overlapped offsets to move relative to each other in a hinging motion, as the laced offsets would do when the cross helicals and legs were not crimped, thereby providing a further increase in firmness.

The present invention is also directed to an innerspring unit including at least one retention and support strip attached thereto along a row as described above. When more than one strip is attached to an innerspring unit, they may be attached to the upper and/or lower terminal convolutions of the coil springs in any of the rows of the unit. A preferred embodiment however is a unit with strips secured to the first, second, and/or third outermost rows at the sides of the unit, which is the region where additional firmness is usually desired. A more preferred embodiment is a unit with strips secured to the terminal convolutions of the springs in the second outermost row at both sides of the unit.

Another preferred embodiment is an innerspring unit including at least one retention and support strip wherein at least one of the legs of the strip(s) not only wraps about the cross helical but also extends through an opening in the length of the retention and support strip. In a more preferred embodiment, the portion of the leg extending through such opening is secured by a clip means.

A further preferred embodiment is an innerspring unit including at least one retention and support strip wherein at least one of the legs of the strip(s) is laced together with the portions of the springs by the cross helical prior to crimping.

A retention and support strip of suitable width that, when attached along a row of coil springs as described above, it prevents surrounding mattress material from working into the coil springs, is another preferred embodiment of the invention.

The invention and its objects, method of operation, features and advantages will be more fully understood by reference to the following drawings and the detailed description.

DETAILED DESCRIPTION OF THE INVENTION

Figure 1:
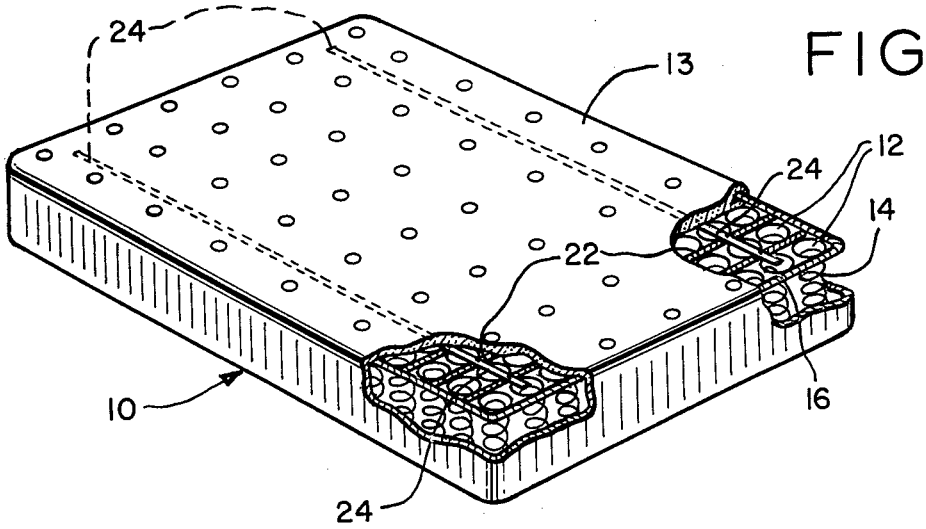
FIG. 1 is a partially cut-away perspective view of an innerspring unit embodying the features of the present invention.

Referring now to the drawings and particularly to FIG. 1, there is illustrated a mattress innerspring unit embodying the features of the present invention and indicated generally by the reference numeral 10. The innerspring unit 10 includes a plurality of coil springs 12 arranged in rows and held together by cross helicals 22. The innerspring unit 10 includes a suitable covering 13 which is well known to those of ordinary skill in the art. In addition, the unit 10 has four retention and support strips, indicated generally by reference numeral 24, secured to the top and bottom of the second row from the longitudinal sides of the unit 10 in a manner to be described in more detail hereinafter. The retention and support strips 24 reduce the tendency of the cross helicals 22 to unwind from the unit 10 and provide additional firmness to the unit 10.

Figure 2:
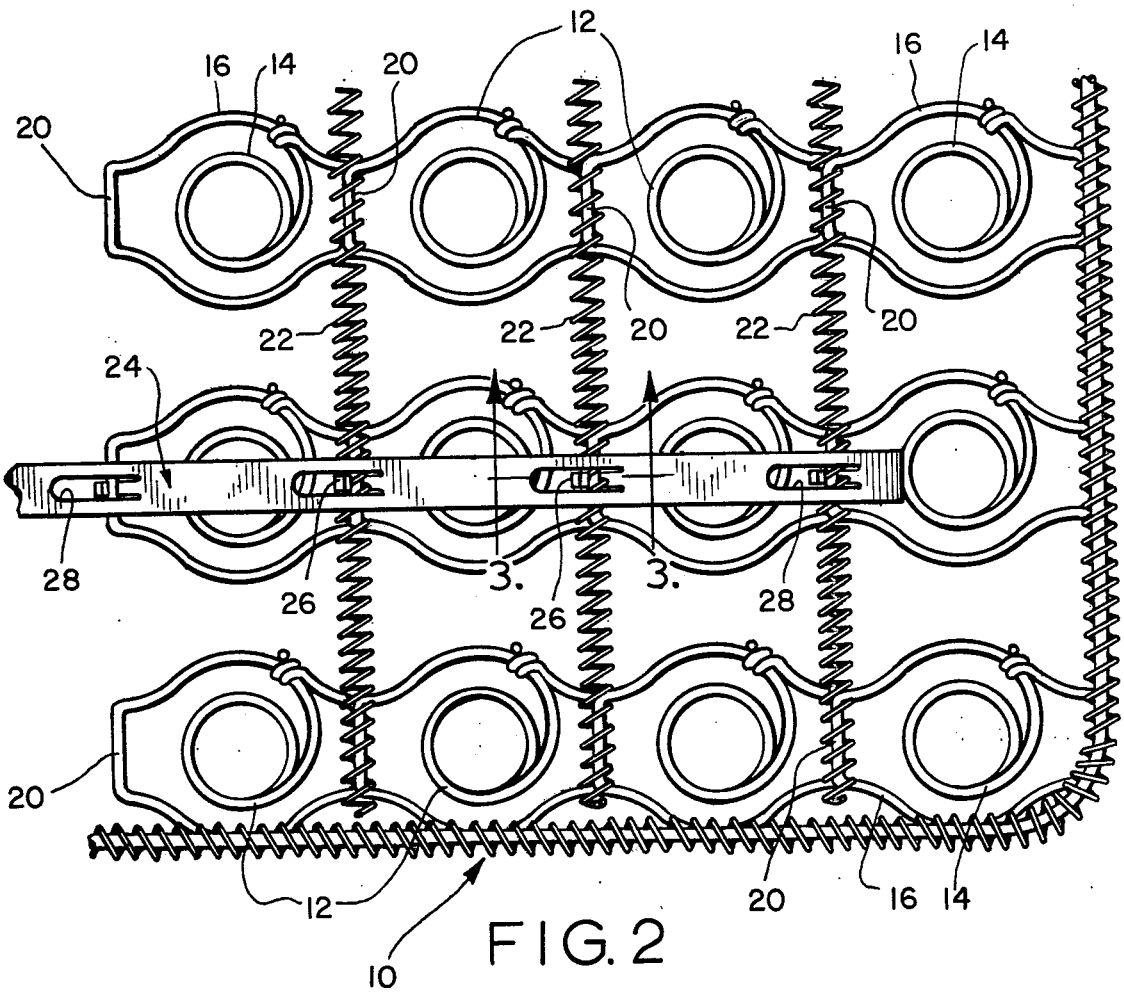
FIG. 2 is a fragmentary top view of the innerspring unit of FIG. 1.
Figure 3:
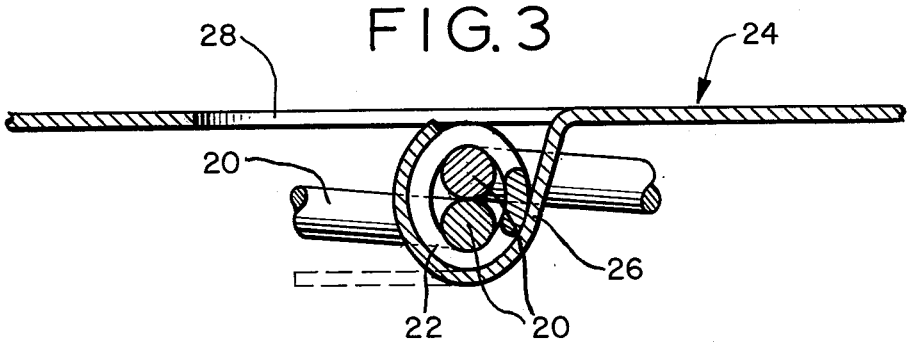
FIG. 3 is a fragmentary cross-sectional view of the innerspring unit of FIG. 2 taken along lines 3—3 of FIG. 2.
Figure 4:
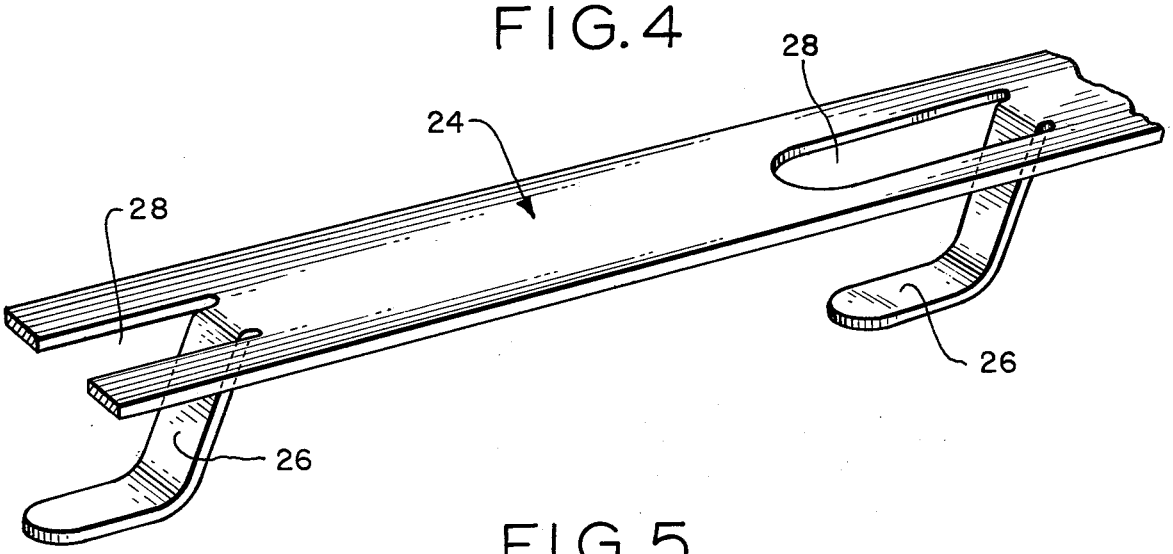
FIG. 4 is a fragmentary perspective view of a retention and support strip embodying the features of the present invention.

Referring now to FIGS. 2, 3 and 4 also, the innerspring unit 10 includes a plurality of coil springs 12 arranged in side by side relation in a plurality of parallel rows. Each coil spring 12 comprises a series of convolutions 14 and a terminal convolution 16 at each end and is preferably tapered from its ends towards the middle so that its convolutions 14 will be of smaller diameter near its center as compared to those near its ends. Only the upper terminal convolution 16 is indicated in the drawings as the other terminal convolution is identical with it. Each terminal convolution 16 is formed to be generally circular in shape with the exception of two offset portions 20. The offsets 20 are preferably U-shaped and are formed so as to be directly opposite each other on each terminal convolution 16. Terminal convolutions 16 need not include two opposed offsets 20. Other suitable configurations, well known to those of ordinary skill in the art, may be used, the selection of which is within the ordinary skill of one in the art.

The coil springs 12 are positioned so that the offset portions 20 are in a substantially abutting or overlapping relationship to offset portions 20 of adjacent coil springs 12 in the same row. The coil springs can best be secured together by spirally rotating cross helicals 22 across each of the rows in a conventional manner so as to interlace adjacent and possibly abutting offsets 20. The cross helicals 22 are positioned in both the upper and lower surface of the innerspring unit 10 although only one surface is shown in FIGS. 1 and 2. The cross helicals 22 are spiral coils of a relatively small diameter in comparison to the coil springs 12 but are sufficiently large to be laced around the adjacent offsets 20, thus holding the coil springs 12 together in both the upper and lower surfaces of the innerspring unit 10.

Across a row in either or both the upper and lower surfaces of the unit, at least one retention and support strip 24 is positioned substantially centered with the terminal convolutions 16 of the coil springs 12 in a row so as to be adjacent to the portion of each cross helicals 22 which interlaces the offsets 20. The length of the strip 24 is positioned overlying the cross helicals 22 and offsets 20 while the legs 26 of the strip 24 extend inwardly toward the unit and partially surround the helicals 22 and offsets 20. The legs 26 are preferably sufficiently wide to contact at least two convolutions of the cross helicals 22. The legs 26 together with the helicals 22 are crimped or deformed such as by compression so that the helicals 22 frictionally engage both the underlying offsets 20 and the overlying legs 26.

The retention and support strip 24 extends along a row lying on the terminal convolutions 16 of the springs 12 in the row. In FIGS. 1 and 2 four strips 24 extend along the second rows adjacent to the longitudinal side of the unit 10, lying on the upper and lower terminal convolutions 16. The strips 24 could however extend along any of the rows in the unit 10.

The retention and support strip 24 is relatively thin and elongated with leg members 26 extending therefrom. The legs 26 are positioned along the strip 24 at intervals corresponding to the distance between adjacent pairs of offsets 20 in a row of coil springs. The strip 24 is positioned along the terminal convolutions 16 of coil springs 12 in a row with the legs 26 extending inwardly with respect to the innerspring unit 10. The legs 26 extend about the circumference of the cross helical coils 22. A pair of adjacent offsets 20 of the coil springs 12 are surrounded by a cross helical 22 and are at least partially surrounded by a leg 26 of the strip 24. Both the helical 22 and the leg 26 are crimped. The crimping reduces the diameter of the cross helical 22 and the curvature of the leg 26 of the retention and support strip 24 to approximately the same cross-sectional area as the adjacent offsets 20 so that the cross helical 22 frictionally engages the offsets 20 and the leg 26 frictionally engages the cross helical 22.

The retention and support strip 24 shown in FIG. 4 is formed from a single strip of material such as metal or plastic sufficiently flexible to be deformed. The legs 26 are shown as being stamped or cut out from a portion of the strip 24 and deformed into a hook-shape, leaving openings 28 along the length of the strip 24. The legs 26 may have tapered ends allowing the legs 26 to easily pass through the opening 28 upon compression together with the cross helicals 22. The legs 26 however could also be separate members secured to the strip 24 which strip 24 could be continuous along its length.

The cross helicals 22 and the legs 26 of the retention and support strip 24 may be crimped by a suitable means, such as a pair of dies, so that the offsets 20 of the coil springs 12 are held against relative hinging movement as described above and is shown best in FIG. 3. The overlapped offsets 20 are preferably unable to move relative to each other. This together with the bridging effect resultant from the retention and support strip 24 being secured to the offsets 20 of the springs 12 along the length of the row, increases the firmness of the unit 10. Further, crimping of a cross helical 22 and a leg 26 about a pair of adjacent offsets 20 frictionally engages the helical 22 together with both the offsets 20 and the leg 26 and the frictional engagement eliminates the tendency of the helical 22 to spin-out of the innerspring unit 10.

Although the present invention provides the greatest increase in firmness of the innerspring unit 10 about the row to which the retention and support strip 24 is attached, such as one of the rows of coil springs 12 near the sides of the unit, other regions of the unit, such as the inner rows of coil springs 12, also are affected regarding increased firmness. It has been found that when four strips 24 are attached to a full size innerspring unit 4 with a 352 coil count along the upper and lower terminal convolutions of the second row of coil springs 12 from the longitudinal border of the unit 10, the firmness of the unit is increased by about 5% at the center of the unit and about 16% at the longitudinal side borders. By firmness is meant here the ratio of the amount of load to extent of coil compression. Moreover, with such an innerspring unit a row of coil springs 12 can be eliminated from the unit 10, reducing the coil count while at least maintaining the overall firmness of the unit 10 when compared to a unit without the strips 16. For instance, when the coil count is lowered by eliminating one row and the remaining coil springs 12 are positioned so that resultant spacial gaps are located between the first and second rows of springs 12 at the side borders, the center of the unit 10 is equally as firm as, and the border regions are 13% firmer than the same unit 10 with a full coil count and without retention and support strips. In these examples, the unit 10 without the retention and support strip 24 has its cross helicals 22 crimped as described in U.S. Pat. No. 3,653,082. Without limiting the invention to any mechanism by which the overall increased firmness is achieved, it is believed the interconnection of the rows by virtue of the cross helicals 22 being secured to each results in spreading of the effect of a retention and support strip 24 over the entire unit 10.

The retention and support strips 24 may be of any suitable material such as stamped metal or formed wire or plastic. Plastic strips 24 including plastic leg member 26 could be further secured to the cross helicals 22 by heat deformation. In a preferred embodiment of the invention, the retention and support strips 24 are constructed from steel strapping and are about ¾ inch wide and 0.028 inch thick and are of a suitable length to stretch from the first to the last pairs of adjacent offsets in the rows of coil springs 12 to which they will be secured.

In another embodiment of the invention, the retention and support strips 24 would be secured by crimping the legs 26 around the cross helicals 22 after the cross helicals 22 have first been crimped about the pairs of adjacent offsets 20.

The retention and support strips 24 may be adapted so that at least one of the cross helicals 22 is laced around an overlying length of the strip 24 and/or a leg 26 as well as the underlying pair of offsets 20 prior to crimping the helicals 22.

In another preferred embodiment of the invention, the retention and support strips 24 are of sufficient width to prevent mattress material from sagging or working their way into the centers of the spring 12 such as strips 24 with a width at least ¼ the cross-sectional diameter of the terminal convolutions 16 of the coil springs 12.

Figure 5:
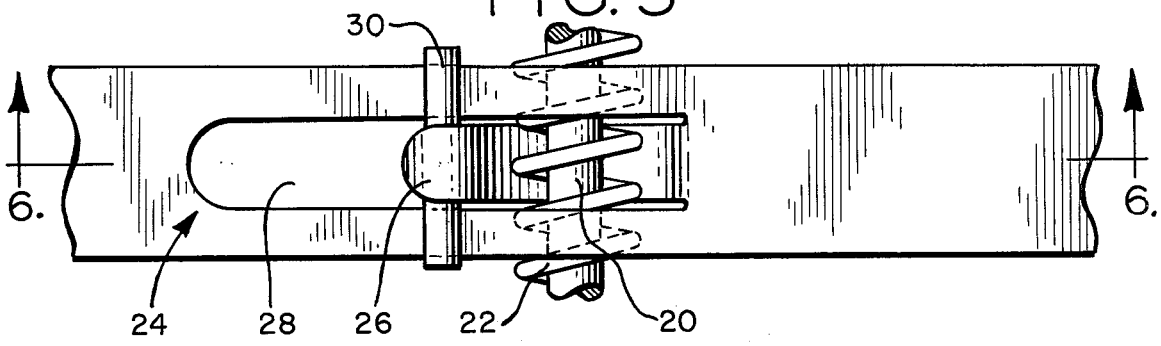
FIG. 5 is a fragmentary top view of an innerspring unit embodying the features of a preferred embodiment of the present invention.
Figure 6:
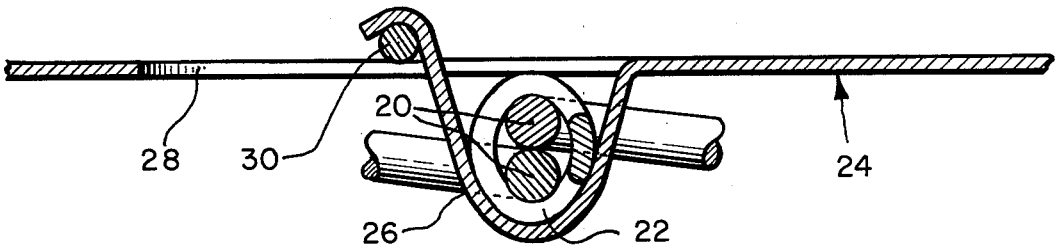
FIG. 6 is a fragmentary cross-sectional view of the innerspring unit of FIG. 5 taken along lines 6—6.

In another preferred embodiment of the present invention illustrated in FIGS. 5 and 6, at least one leg 26 of the retention and support strip 24 is not only wrapped around a portion of a cross helical 22 and the underlying pair of adjacent and possibly overlapped offsets 20 and extends through the opening 25 in the strip 24 but is further secured by a pin means 30 which pin 30 may simply extend transversely of the length of the strip 24. As illustrated, the length of the pin 30 is approximately the same as the width of the strip 24 and the leg 26 is curved over and partially around the pin 30. The leg 26 is sufficiently rigid that once deformed in this manner, it will hold the pin 30 in place and the pin 30 will prevent any tendency of the leg 26 to disengage from its frictional engagement with the cross helical 22.

It will be understood that changes may be made in the details of construction, arrangement and operation without the departing from the spirit of the invention, particularly as defined in the following claims.

I claim:

1. A retention and support strip for attachment to a mattress innerspring unit with cross helicals which extend transversely of the unit and lace together terminal convolutions of adjacent coil springs in the rows, to reduce spin-out of the cross helicals and increase firmness of the innerspring unit comprising:

a strip including leg members for extending about the cross helicals of the innerspring unit and for being crimped together with the cross helicals about the terminal convolutions of adjacent coil springs in a row when said strip overlies the terminal convolutions of the coil springs in a row.

2. The retention and support strip of claim 1 wherein the leg members have a width at least equal to the length of two convolutions of a cross helical.

3. The retention and support strip of claim 1 wherein said strip is formed from a single length of material and said leg members are cut out along three sides from said length.

4. The retention and support strip of claim 3 wherein said legs have tapered ends.

5. The retention and support strip of claim 4 wherein the strip is formed of metal.

6. The retention and support strip of claim 4 wherein the strip is formed of plastic.

7. The retention and support strip of claim 5 wherein the strip is formed of steel strapping and is about ¾ of an inch wide and about 0.028 of an inch thick.

8. In a generally rectangular mattress innerspring unit, a spring structure comprising:

a. a plurality of coil springs arranged in side by side relation in a plurality of parallel rows, said coil springs including opposed terminal convolutions;

b. said terminal convolutions of said springs adapted to substantially abut adjacent terminal convolutions of adjacent springs in the rows;

c. a plurality of cross helicals extending transversely of said rows and coiling about pairs of substantially abutting adjacent terminal convolutions so that adjacent springs are interconnected;

d. at least one retention and support strip extending along at least one row of the unit overlying a plurality of terminal convolutions of the coil springs in said row, said strip having a plurality of leg members along its length which partially surround the circumference of said cross helicals; and e. said legs and said cross helicals being deformed so that said cross helicals frictionally engage said pairs of adjacent terminal convolutions in said rows of springs and said legs frictionally engage said cross helicals wherein said strip firms the surrounding area of the unit and substantially prevents cross helical spin-out.

9. The innerspring unit of claim 8 wherein the retention and support strips extend along both the upper and lower terminal convolutions of springs in a row, and are unsecured to any portion of the unit at their ends.

10. The second spring unit of claim 9 wherein the strips extend along the second row of springs adjacent to the longitudinal side border of the unit.

11. The spring unit of claim 8 wherein the substantially abutting portions of the terminal convolutions are U-shaped offsets.

12. The spring unit of claim 11 wherein said adjacent offsets overlap.

13. The innerspring unit of claim 8 wherein said retention and support strips are elongated pieces of material selected from the group consisting of metal and plastic in which said leg members are cut from said strip along three sides.

14. The innerspring unit of claim 8 wherein said strip is formed wire.

15. The innerspring unit of claim 13 wherein said strip is flexible plastic.

16. The innerspring unit of claim 15 wherein said strip is deformed both by compression and heat.

17. The innerspring unit of claim 8 wherein the width of the retention and support strip is at least ¼ the diameter of the terminal convolutions of the coil springs.

18. The innerspring unit of claim 13 wherein the strip is formed of steel strapping and is about ¾ of an inch wide and about 0.028 of an inch thick.

19. The innerspring unit of claim 13 where the strip is further secured to the unit by a pin which overlies the strip and extends transversely thereof about which the end of the leg is wrapped.

20. The innerspring unit of claim 8 wherein said leg members frictionally engage said cross helicals about at least two convolutions of each of said cross helicals.

21. The innerspring unit of claim 8 only wherein four strips are present and the strips extend along the second rows of springs adjacent to the longitudinal side border of the unit along both the upper and lower terminal convolutions of said springs in said second rows.

22. In a generally rectangular mattress innerspring unit, a spring structure comprising:

a. a plurality of coil springs arranged in side by side relation in a plurality of parallel rows, said coil springs including opposed terminal convolutions;

b. said terminal convolutions of said springs adapted to substantially abut adjacent terminal convolutions of adjacent springs in the rows;

c. a plurality of cross helicals extending transversely of said rows and coiling about pairs of substantially abutting adjacent terminal convolutions so that adjacent springs are interconnected;

d. at least one retention and support strip extending along at least one row of the unit overlying a plurality of terminal convolutions of the coil springs in said row, said strip having a plurality of leg members along its length which partially surround the circumference of said cross helicals and a plurality of openings through which the ends of the legs extend;

e. said legs and said cross helicals being deformed so that said cross helicals frictionally engage said pairs of adjacent terminal convolutions in said rows of springs and said legs frictionally engage said cross helicals; and said strip being further secured to the unit by at least one pin which overlies the strip and extend transversely thereof, the leg of the strip being at least partially wrapped about said pin.

23. The innerspring unit of claim 22 wherein the retention and support strips extend along both the upper and lower terminal convolutions of springs in a row.

24. The innerspring unit of claim 23 wherein the strips extend along the second row of springs adjacent to the longitudinal side border of the unit.

25. The innerspring unit of claim 24 wherein the substantially abutting portions of the terminal convolutions are U-shaped offsets.

26. The innerspring unit of claim 25 wherein said adjacent offsets overlap.

27. The innerspring unit of claim 26 wherein said retention and support strips are elongated pieces of material selected from the group consisting of metal and plastic in which said leg members are cut from said strip along three sides.

28. The innerspring unit of claim 27 wherein said strip is flexible plastic.

29. The innerspring unit of claim 28 wherein said strip is deformed both by compression and heat.

30. The innerspring unit of claim 29 wherein the width of the retention and support strip is at least ¼ the diameter of the terminal convolutions of the coil springs.

31. The innerspring unit of claim 30 wherein the strip is formed of steel strapping and is about ¾ of an inch wide and about 0.028 of an inch thick.

32. In a generally rectangular mattress innerspring unit, a spring structure comprising:

a. a plurality of coil springs arranged in side by side relation in a plurality of parallel rows, said coil springs including opposed terminal convolutions;

b. said terminal convolutions of said springs adapted to substantially abut adjacent terminal convolutions of adjacent springs in the rows;

c. a plurality of cross helicals extending transversely of said rows and coiling about pairs of substantially abutting adjacent terminal convolutions so that adjacent springs are interconnected;

d. at least one retention and support strip extending along at least one row of the unit overlying a plurality of terminal convolutions of the coil springs in said row, said strip having a plurality of leg members along its length which partially surround the abutting adjacent terminal convolutions; and e. at least one cross helical lacing together said adjacent terminal convolutions and a portion of the retention and support strip adjacent said terminal convolutions and said strip and cross helicals being deformed to frictionally engage said adjacent terminal convolutions.

33. The innerspring unit of claim 32 wherein the retention and support strips extend along both the upper and lower terminal convolutions of springs in a row.

34. The innerspring unit of claim 33 wherein the strips extend along the second row of springs adjacent to the longitudinal side border of the unit.

35. The innerspring unit of claim 34 wherein the sustantially abutting portions of the terminal convolutions are U-shaped offsets.

36. The innerspring unit of claim 35 wherein said adjacent offsets overlap.

37. The innerspring unit of claim 36 wherein said retention and support strips are elongated pieces of material selected from the group consisting of metal and plastic in which said leg members are cut from said strip along three sides.

* * * * *

UNITED STATES PATENT AND TRADEMARK OFFICE

CERTIFICATE OF CORRECTION

PATENT NO. : 4,092,749

DATED : June 6, 1978

INVENTOR(S) : KLANCNIK, ALVIN R.

It is certified that error appears in the above-identified patent and that said Letters Patent are hereby corrected as shown below:

Claim 10, line 1, cancel "second".

Claim 35, line 2, cancel "sustantially" and insert -- substantially --.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*